US005977526A

United States Patent [19]

Mattord et al.

[11] Patent Number: 5,977,526

[45] Date of Patent: Nov. 2, 1999

[54] HEATER FOR HIGH VACUUM OPTICAL VIEW PORT

[75] Inventors: Terry J. Mattord, Austin, Tex.; Michael H. Gilbert, Sr., North Olmsted, Ohio

[73] Assignee: Board of Regents The University of Texas, Austin, Tex.

[21] Appl. No.: 09/263,714

[22] Filed: Mar. 5, 1999

[51] Int. Cl.[6] ..... H05B 3/10

[52] U.S. Cl. ..... 219/552; 373/11

[58] Field of Search ..... 373/11, 112, 110; 392/418, 389; 422/102, 99; 219/520, 522, 526, 538, 542, 543, 548, 552

[56] References Cited

U.S. PATENT DOCUMENTS 3,973,075 8/1976 Borkowski ..... 373/11

5,343,022 8/1994 Gilbert, Sr. et al. ..... 219/552

*Primary Examiner*—Tu Ba Hoang

*Attorney, Agent, or Firm*—Eugene Lieberstein; Michael N. Meller

[57] ABSTRACT

A heated view port for in-situ optical observation of a deposition chamber in a vessel under high vacuum application comprising a plurality of superimposed layers arranged in the shape of an annular band mounted around the view port substantially at the outer periphery thereof. The band includes a first layer of pyrolytic boron nitride, a second layer of pyrolytic graphite covering at least one surface of the pyrolytic boron nitride layer, an outer layer of pyrolytic boron nitride and two electrical contact terminals in contact with the pyrolytic graphite layer in an arrangement forming parallel resistive paths between the contact terminals. The terminal contacts are connected to an external source of electrical power.

10 Claims, 3 Drawing Sheets

HEATER FOR HIGH VACUUM OPTICAL VIEW PORT

FIELD OF INVENTION

This invention relates to a heater for heating the optical view port of a chamber within a vessel under relatively high vacuum conditions and to an improved optical view port and heater assembly for a vacuum chamber to permit in-situ optical observation of the process operation within the vacuum chamber.

BACKGROUND OF THE INVENTION

Many processes are carried out under high and even ultra high vacuum conditions within a chamber of a vessel representing a rigid wall structure enclosing an interior space. To observe e.g. a deposition operation in the manufacture of semiconductor devices while the operation is being carried under high vacuum conditions at high temperature a view port is built into a flange assembly of the rigid wall structure to permit spectral observation, optical thermometry and optical reflectivity. The view port is composed of a glass composition or of sapphire depending upon the thermal and gaseous environment in the chamber and the degree of vacuum. Heating the view port is known to prevent condensation build up which obscures the optical clarity of the view port. Heretofore the view port was heated by means of a wire filament of preferably tantalum attached to the view port and to the power feed through of the vacuum apparatus. The joining of a wire filament as practiced in the prior art to cause heating of the view port is difficult, expensive and unreliable.

SUMMARY OF THE INVENTION

A heater has been developed in accordance with the present invention for heating a view port under high vacuum application which is easily affixed to the view port and is inexpensive and reliable in operation. The heater of the present invention applies heat to the view port of a vessel under relatively high vacuum application and comprises a plurality of superimposed layers arranged in the shape of a band having a first layer of pyrolytic boron nitride, a second layer of pyrolytic graphite covering at least one surface of said pyrolytic boron nitride layer, an outer layer of pyrolytic boron nitride and two electrical contact terminals in contact with said pyrolytic graphite layer in an arrangement forming parallel or series resistive paths between the contact terminals with the contact terminals being symmetrically located at diametrically opposite positions along said band and being adapted for electrical connection to an external source of electrical power.

The present invention is also directed to a heated view port for in-situ optical observation of a deposition chamber in a vessel under high vacuum application comprising a plurality of superimposed layers arranged in the shape of an annular band mounted around the view port substantially at the outer periphery thereof with the band comprising a first layer of pyrolytic boron nitride, a second layer of pyrolytic graphite covering at least one surface of said pyrolytic boron nitride layer and an outer layer of pyrolytic boron nitride, two electrical contact terminals in contact with said pyrolytic graphite layer in an arrangement forming parallel or series resistive paths between the contact terminals with the contact terminals being symmetrically located at diametrically opposite positions along said band, and conductor means for electrically connecting said terminal contacts to an external source of electrical power.

BRIEF DESCRIPTION OF THE DRAWINGS

Other advantages of the present invention will become apparent from the following detailed description of the invention when read in conjunction with the accompanying drawings of which.

DETAILED DESCRIPTION OF THE INVENTION

Figure 1:
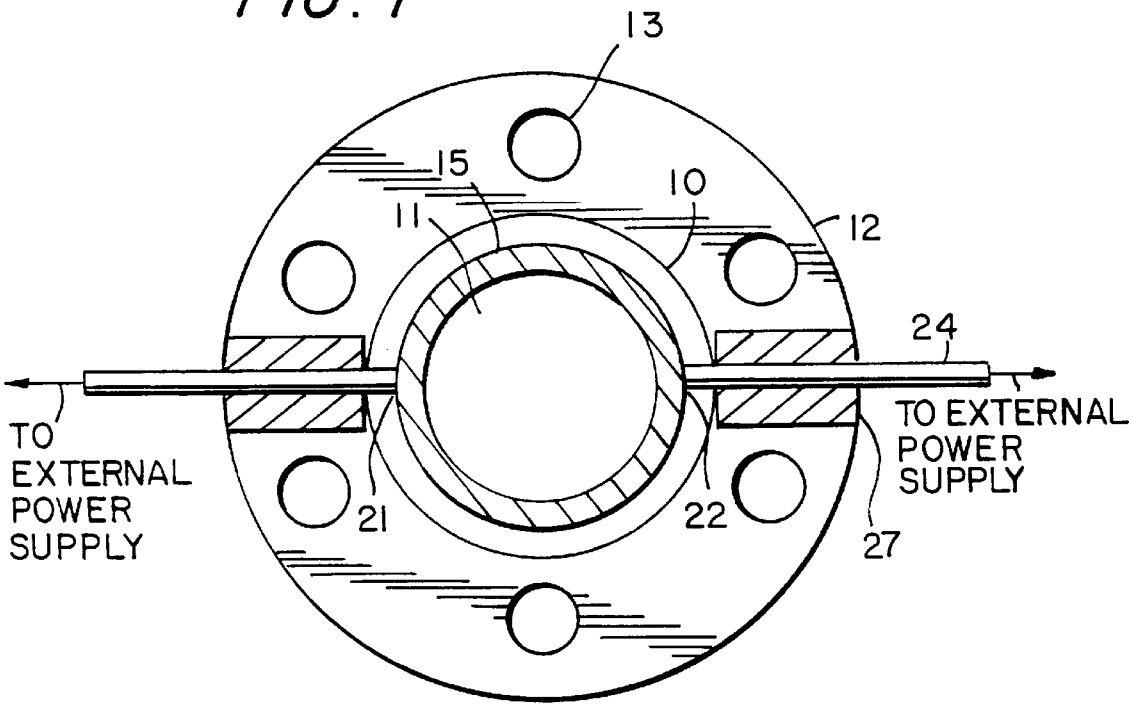
FIG. 1 is a plan view of one embodiment of the heated view port of the present invention.

The heated view port 10 of the present invention is shown in FIG. 1 comprising an optical window 11 of glass or sapphire surrounded by a mounting flange 12 which is bolted through holes 13 to the rigid wall structure of a vessel (not shown) enclosing a chamber for performing a deposition operation such as, for example, the deposition of elemental semiconductor material and metals upon a substrate under high vacuum application and at specified temperature conditions. One such process is known as molecular beam epitaxy (MBE) in which a preselected effusion material of e.g., gallium, arsenic etc. is placed into one or more effusion cells mounted in a growth chamber of the vessel under high vacuum. The effusion deposition process in the chamber may be visually observed from the window 11 of the view port 10. A heater 15 is maintained in physical contact with the window 11 of the view port 10 to directly heat the window 11 by resistive heating.

The heater 15 is composed of a material having a configuration preferably of a geometry in conformity with the geometry of the window 11. Accordingly, for a circular window the heater should be annular in geometry and preferably located adjacent to or approximately surrounding the outer periphery of the window 11. However, it should be understood that it is not essential for the heater 15 to have an annular geometry and its geometry need not conform to the geometry of the window 11. The heater 15 is composed of a pyrolytic boron nitride base layer 17, an intermediate layer of pyrolytic graphite 18 and an overlayer of pyrolytic boron nitride 19 except at the opposite ends 21 and 22 which form contact terminals for the heater 15. The overall shape of the heater is in the form of a relatively flat band with the contact terminals 21 and 22 positioned at diametrically opposite locations in horizontal alignment. The contact terminals 21 and 22 may alternatively be located on opposite sides from one another or adjacent one another and are adapted to be connected to an external power source and when so connected form two electrical resistive circuits or paths in parallel with one another. The formation of parallel electrical resistive paths in this way has the effect of minimizing the electrical resistance of the heater 15. In the embodiment of FIG. 1 the two contact terminals 21 and 22 are connected to wire connector leads 23 and 24 which extend through mounting brackets 26 and 27 affixed to the mounting flange 12 to an external source of power (not shown).

Figure 2:
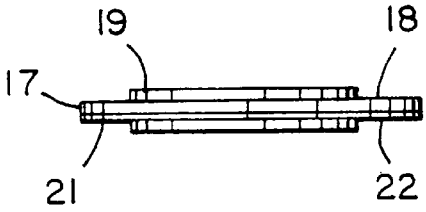
FIG. 2 is an side view of the heater in the heated view port of FIG. 1 the thickness of which is enlarged to identify the different layers of the heater.

The contact terminals 21 and 22, as shown in FIG. 2, consist of only the pyrolytic boron nitride base layer 17 and the surrounding pyrolytic graphite layer 18. The cross sectional thickness of the contact terminals 21 ands 22 are much thinner than the cross sectional thickness of the body of the heater 15.

Figure 3:
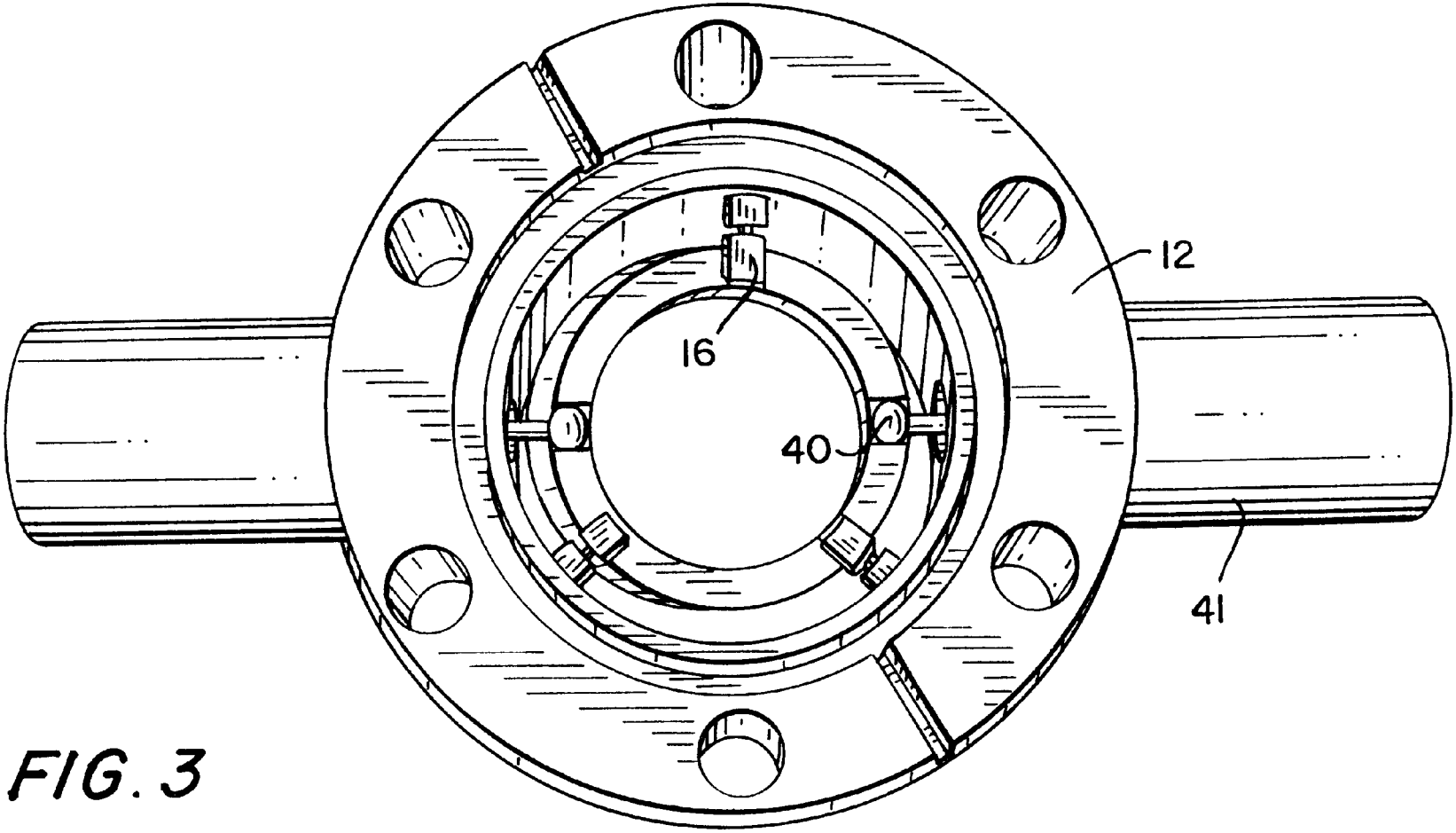
FIG. 3 is an isometric view of the heated view port and mounting flange of a high vacuum vessel showing the attachment of the heater to the view port.

An isometric drawing of the heater 15 mounted on the view port 10 is shown in FIG. 3. The heater 15 is mounted by clamps 16 extending from the mounting flange 12. The power cable 40 which connects the heater 15 to an external source of power (not shown) is fed through a conduit 41 which may be connected to a pump for forming a vacuum in the chamber of the vessel (not shown) being observed through the view port 10.

Pyrolytic boron nitride (PBN) is formed by chemical vapor deposition of boron nitride in a reactor chamber by the vapor phase reaction of ammonia and a boron containing gas such as boron trichloride as is well known. Pyrolytic graphite may also be formed by chemical vapor deposition of, for example, methane gas at high temperature in a reactor chamber with a suitable inert diluent. The use of pyrolytic boron nitride (PBN) and pyrolytic graphite for forming a heating unit to heat an MBE effusion cell by resistive heating is taught in U.S. Pat. No. 5,343,022 the disclosure of which is incorporated herein by reference.

The preferred method for fabricating the heater 15 of the present invention is to form a deposit of pyrolytic boron nitride (PBN) which is machined into an annular shape to form a band of PBN having an annular shape in the form of a ring 17. A thin layer coating 18 of pyrolytic graphite is deposited by CVD over the pyrolytic boron nitride ring 17. The pyrolytic graphite coating is then removed from one side of the ring 17 except for two small areas 21 and 22 at opposite ends of the ring which constitute the contact terminals for the heater 15. The areas defining the contact terminals 21 and 22 are then masked on both sides of the ring 17 and an outer coating 19 of PBN is deposited over the layer 18 such that upon removal of the mask the contact terminals 21 and 22 are exposed. The wire leads 23 and 24 may be joined to the contact terminal 21 and 22 by soldering or any other conventional method.

Figure 5:
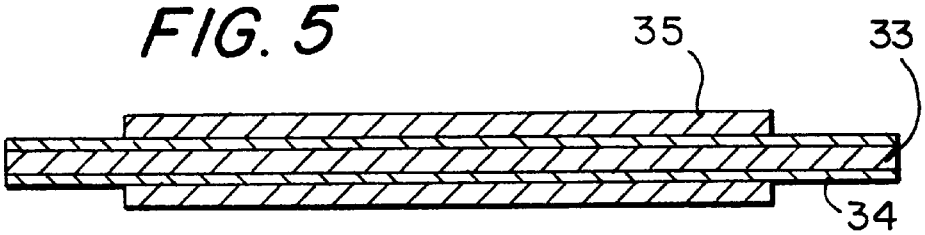
FIG. 5 is a side view of the heater of FIG. 4.
Figure 4:
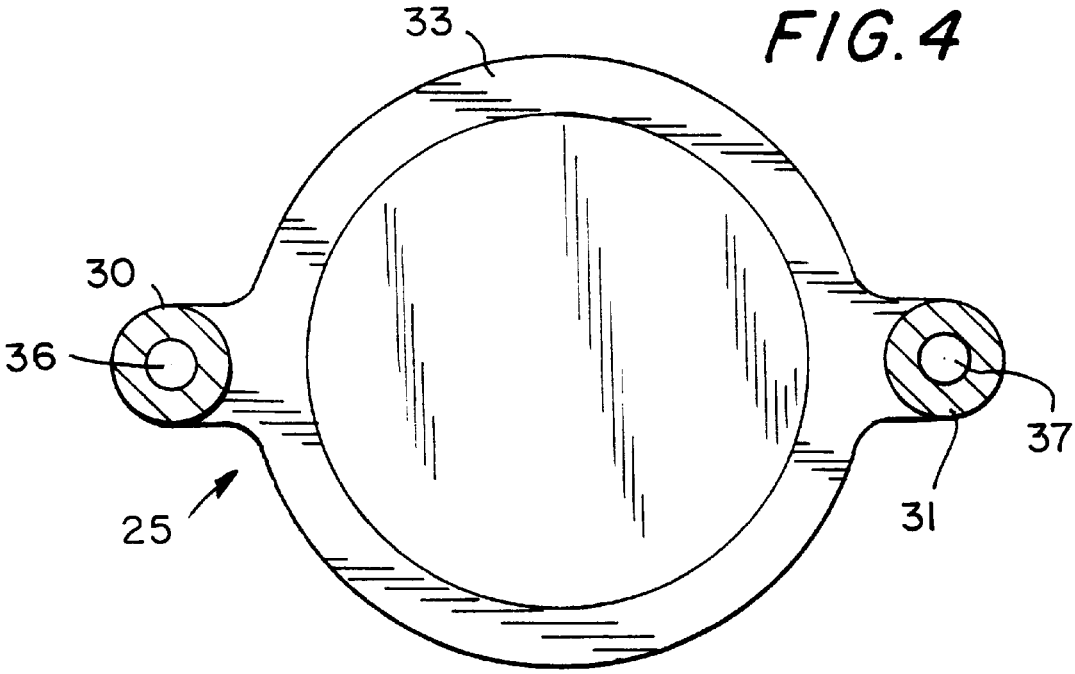
FIG. 4 is an alternate embodiment of the heater of the present invention.

An alternate heater configuration is shown in FIGS. 4 and 5 respectively in which a base deposit of pyrolytic boron nitride (PBN) is machined into an annular shape except at two opposite ends 30 and 31 which project from the annular region 33 to form tabs at each of the opposite ends 30 and 31. The fabrication operation is otherwise identical to that explained above for the embodiment of FIGS. 1–2 resulting in forming a heater 25 having a base layer 33 of PBN, a pyrolytic graphite layer 34 and an outer layer 35 except at the opposite ends 30 and 31 which constitute contact terminals for the heater 25 equivalent to the contact terminals 21 and 22 in FIGS. 1–2. A hole 36 and 37 is drilled through each of the opposite tabular ends 30 and 31 to facilitate the attachment of screws to wire conductor leads (not shown) for connecting the heater 25 to an external source of power (not shown).

What we claim is:

1. A heater for applying heat to the view port of a vessel under relatively high vacuum application comprising a plurality of superimposed layers arranged in the shape of a band having a first layer of pyrolytic boron nitride, a second layer of pyrolytic graphite covering at least one surface of said pyrolytic boron nitride layer, an outer layer of pyrolytic boron nitride and two electrical contact terminals in contact with said pyrolytic graphite layer in an arrangement forming parallel or series resistive paths between the contact terminals with the contact terminals being symmetrically located at diametrically opposite positions along said band and being adapted for electrical connection to an external source of electrical power.

2. A heater as defined in claim 1 wherein said band of superimposed layers is annular in shape.

3. A heater as defined in claim 1 wherein each contact terminal is formed by exposing the pyrolytic graphite at the desired contact terminal position along said band.

4. A heater as defined in claim 3 wherein said two contact terminals are horizontally aligned.

5. A heater as defined in claim 4 further comprising wire lead conductors for connecting said contact terminals to an external source of electrical power.

6. A heater as defined in claim 5 wherein said wire lead conductors are held by a mounting flange supporting the viewport.

7. A heater as defined in claim 1 wherein said band of superimposed layers has an annular shape except for two tabular regions extending therefrom in which said contact terminals are formed.

8. A heater as defined in claim 7 wherein each tabular region has a hole for facilitating attachment of the contact terminals to a fastener.

9. A heated view port for in-situ optical observation of a deposition chamber in a vessel under high vacuum application comprising a plurality of superimposed layers arranged in the shape of an annular band mounted around the view port substantially at the outer periphery thereof with the band comprising a first layer of pyrolytic boron nitride, a second layer of pyrolytic graphite covering at least one surface of said pyrolytic boron nitride layer and an outer layer of pyrolytic boron nitride, two electrical contact terminals in contact with said pyrolytic graphite layer in an arrangement forming parallel resistive paths between the contact terminals with the contact terminals being symmetrically located at diametrically opposite positions along said band, and conductor means for electrically connecting said terminal contacts to an external source of electrical power.

10. A heated view port as defined in claim 9 further comprising clamp means for mechanically clamping said band to said view port with said contact terminals in horizontal alignment.

* * * * *